US005706528A

United States Patent [19]

Broback

[11] Patent Number: 5,706,528

[45] Date of Patent: Jan. 13, 1998

[54] TOILET PLUNGER SPLASH PREVENTION

[76] Inventor: William A. Broback, 12507 Dorchester Ct., Apple Valley, Minn. 55124

[21] Appl. No.: 542,295

[22] Filed: Oct. 12, 1995

Related U.S. Application Data

[63] Continuation-in-part of Ser. No. 432,987, May 2, 1995.

[51] Int. Cl.[6] ..... E03D 9/00

[52] U.S. Cl. ..... 4/253; 4/255.01; 4/255.11

[58] Field of Search ..... 4/242.1, 244.3, 4/253, 255.01, 255.05, 255.11, 255.12, 300.3, 661

[56] References Cited

U.S. PATENT DOCUMENTS

| | | | |
|---|---|---|---|
| D. 341,414 | 11/1993 | Baker | 4/300.3 X |
| 679,007 | 7/1901 | Senff | 4/253 X |
| 733,787 | 7/1903 | Woodruff | 4/253 |
| 3,083,919 | 4/1963 | Farner | 4/661 X |
| 3,858,418 | 1/1975 | Butler | 4/666 X |
| 4,458,368 | 7/1984 | Webb | 4/255.11 |
| 4,690,413 | 9/1987 | Adkins | 277/199 |
| 4,831,669 | 5/1989 | Edwards | 4/255.11 |
| 4,922,555 | 5/1990 | Bonilla et al. | 4/255.11 |
| 5,099,527 | 3/1992 | Roose | 4/255.11 |

*Primary Examiner*—Robert M. Fetsuga
*Attorney, Agent, or Firm*—R. C. Baker & Assoc., Ltd.

[57] ABSTRACT

A system for containing the splashing produced when using a toilet plunger to unclog a flush toilet is comprised of a substantially flat stiff splash plate that covers the upper opening of a toilet bowl when the plate is rested on the toilet bowl rim. The plate is visually transparent and has a central aperture for a plunger handle to freely pass through. A gasket is interposed between the plate and the toilet bowl rim and is formed of an absorbent paper material that may be disposed of by flushing it down the toilet drain after use. A method of using the splash plate and the gasket utilizes the transparency of the splash plate and the disposability of the gasket. The splash plate may optionally have stiffness enhancing features including a contoured portion and a perimeter flange. A kit of equipment has a splash plate, a gasket and a reclosable envelope for holding the splash plate and gasket.

3 Claims, 2 Drawing Sheets

1/2

TOILET PLUNGER SPLASH PREVENTION

CROSS-REFERENCE TO RELATED APPLICATION

This application is a continuation-in-part of my application Ser. No. 08/432,987, filed May 2, 1995.

BACKGROUND OF THE INVENTION

This invention relates generally to a method and apparatus for preventing the accidental splashing of waste matter outside a flush toilet bowl when using a toilet plunger to unclog the drain of the toilet.

Toilets of the most recent vintage conserve water by using, as compared to older models, a substantially reduced water flow (as low as about 5.5 liters (about 1.5 gallons) or less per flush) and smaller waste drain passages. These new toilets are more prone to clogging than older models.

Toilet drains are usually unclogged by using a toilet plunger comprised of a large deformable plunger cup mounted on the end of an elongated handle shaft. During the plunger operation, the plunger cup is held over the mouth of the toilet bowl drain while the plunger handle is reciprocated in an upward and downward motion that alternately contracts and enlarges the space within the cup. Preferred plunging action creates an alternating pressure and suction force in the drain passage that is often sufficient to dislodge an obstruction. The pressure created within the toilet drain during this action will often cause water to spray out from any gaps between the plunger cup and the bowl surface with great force, and then splash up and outside of the toilet bowl onto the plunger operator and onto nearby walls and floors.

Known devices that have heretofore been proposed to confine the aforedescribed splashing suffer from drawbacks that make them difficult to use and hinder their effectiveness. Circular disks proposed for mounting on the plunger handle may shield the hands grasping the handle but are ineffective against water splashing through the significant gap between the edges of the disk and the bowl rim. Devices designed for attachment below or on the rim of the toilet bowl can block more of the splashing, but known devices of this type have rim mounting structures tailored for a special style of mounting or for particular bowl rim shapes and sizes, and thus lack versatility of use. Further, the known rim-supported devices appear to be opaque and require removal from the rim in order to check the alignment of the plunger cup with the bowl drain and also to periodically check if the plunging action has unclogged the drain. Their use is tedious, and the repeated removal of the device to check on the plunging operation increases the risk of splashing or dripping waste outside the bowl.

Still further, the ease of cleaning known devices for storage and later reuse is a significant concern when one considers the environment in which they are to be used. Devices that mount underneath the rim of the bowl are susceptible to being submerged in the water and waste matter trapped in the bowl, and require extensive cleaning that may create additional mess outside the bowl. Complex and multi-piece devices (incorporating, for example, diaphragms and special sealing members) have nooks and crannies that are exposed to splashing and require substantial cleaning effort after use to ensure sanitary storage for reuse.

What has been needed is a device that is simple and effective for use in containing the toilet plunger splashing, as well as simple and easy to clean for sanitary storage and future reuse.

SUMMARY OF THE INVENTION

The invention provides a system for containing the splashing accidentally produced when using a toilet plunger to unclog a flush toilet. Flush toilets characteristically have a bowl with an upper opening and a lower drain mouth below the upper opening, and a bowl rim with a flat horizontal upper surface surrounding the upper opening of the bowl. A plunger useful in practicing the invention has an elongate handle shaft and a deformable plunger cup mounted thereon for positioning over the drain mouth of the bowl.

The splash-containing system of the invention includes a substantially flat, stiff and unitary splash plate that has an outer perimeter edge and a flat perimeter border inwardly adjacent to said perimeter edge. The plate is of a size adapted to cover the upper opening of a toilet bowl when the perimeter border of the plate is rested upon the upper surface of the bowl rim. The plate is visually transparent and has a central aperture formed therein of a size just sufficiently large to permit free movement therethrough of the handle shaft of the plunger. The system ideally includes a gasket for interposition between the plate and the upper surface of the bowl rim to form a barrier therebetween. The gasket is formed of paper material that is capable of sufficient disintegration after being immersed in water to permit disposal of the gasket by flushing it down the drain mouth of the toilet.

The preferred gasket has an embossed surface and is a discrete entity unattached to the splash plate. The preferred splash plate has a planar top face and a planar bottom face and is formed from a single uniformly thick panel of material having a thickness not over about 0.5 cm.

The invention also provides a kit of equipment for preventing accidental splashing of waste outside a flush toilet bowl when using a plunger to unclog the flush toilet, and consists essentially of a splash plate basically as characterized above and an envelope for receiving the splash plate therein. The envelope has an opening with closure means mounted thereabout for permitting repeated opening and reclosure of the envelope. The envelope provides a store sales display container for the splash plate prior to purchase of the kit and provides a convenient reusable storage container for the splash plate between uses of the plate after purchase of the kit.

Another embodiment of the system of the invention has a splash plate basically as characterized above featuring an inner contoured portion substantially encircling the aperture and located inward of the flat perimeter border. The contour of the inner contoured portion is a protrusion out of the plane of the flat perimeter border, and the protrusion is less than about 3 cm in height and is effective to enhance the overall stiffness of the splash plate. The area of the protrusion is less than the area of flat portions of the splash plate, and the splash plate has a uniform thickness of less than about 0.5 cm.

In a preferred contoured splash plate, the outer perimeter edge has a curved edge portion lying in the plane of the perimeter border and a substantially straight edge portion lying in the plane of the perimeter border, and the splash plate additionally comprises a perimeter flange depending downwardly solely from the curved edge portion of the perimeter edge.

The method of the invention prevents accidental splashing of waste outside the toilet bowl while using a plunger to unclog the toilet. This method includes providing a substantially flat, stiff and unitary visually transparent plastic splash plate having an outer perimeter edge and a flat perimeter border inwardly adjacent of the perimeter edge. The plate is of a size adapted to cover and rest upon the upper surface of the toilet bowl rim. The plate is provided with a central aperture of a size just sufficiently large to permit free movement therethrough of the handle shaft of the plunger but insufficiently large to permit movement of the deformable plunger cup of the plunger therethrough. The plate is not more than about 0.5 cm thick and is uniformly thick throughout all portions thereof. The elongate handle shaft of the plunger is inserted into the central aperture of the plate. The flat perimeter border of the plate is rested over the flat upper surface of the toilet bowl rim after inserting the handle shaft of the plunger into the central aperture. The plate is manually, by one hand or foot, pressed against the upper surface of the toilet bowl rim to temporarily hold the perimeter border of the plate against the upper surface of the bowl rim without the use of adhesives and without the use of any mechanical structural elements. Simultaneous with applying pressure to the plate, the plunger handle is reciprocated through the aperture of the plate to effect action by the deformable plunger cup of the plunger upon the drain mouth of the toilet bowl.

The action of the deformable plunger cup on the drain mouth of the toilet bowl is adjusted according to the conditions of clogging visually observed through the visually transparent plate as the plunger handle is being reciprocated through the central aperture. The flat visually transparent plate is then removed from the toilet bowl rim and is cleaned of any waste on it.

The preferred method includes placing a gasket upon the flat upper surface of the bowl rim before resting the flat perimeter border of the plate over the bowl rim and later removing the plate from the toilet bowl rim without removing the gasket from the upper surface of the rim. Also, after use, the gasket is simply moved or slid from the upper surface of the bowl rim into the toilet bowl and then flushed down the drain mouth of the toilet.

Still other features and benefits of the invention will be evident as this description proceeds.

DESCRIPTION OF THE PREFERRED EMBODIMENTS

Figure 1:
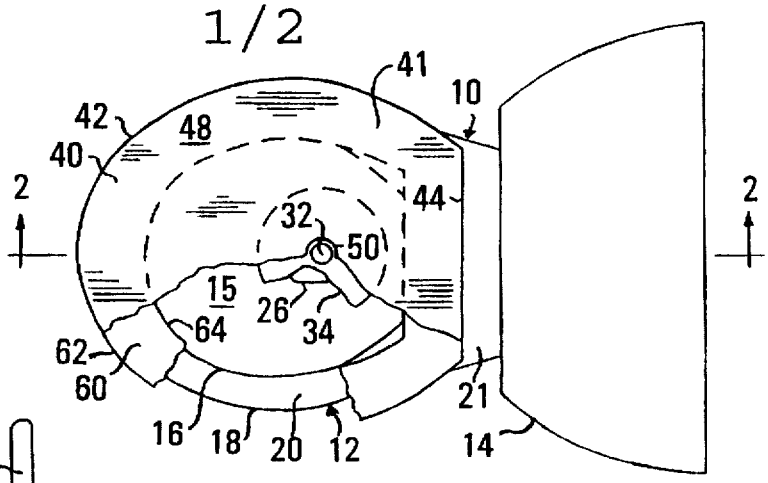
FIG. 1 is a schematic top view of the splash plate and the gasket of the invention resting on the rim of a toilet bowl, with portions broken away to show underlying detail and with broken lines showing features visible through the visually transparent plate.

The splash control system of the invention is generally comprised of a splash plate 40 and a gasket 60 (see FIGS. 1 and 2) for resting on the bowl rim 18 of a flush toilet bowl 12 during the use of a plunger 28 to unclog the toilet drain 30.

An illustrative flush toilet 10 is generally comprised of a bowl 12 incorporated into a toilet base portion that supports a toilet tank 14 for holding water to flush waste matter from the interior of the bowl 12. The toilet bowl 12 has a generally concave interior surface 15 that opens upwardly to an upper opening 16 surrounded by a bowl rim 18. The bowl rim 18 is characterized by having a substantially flat and horizontal exterior upper surface 20 upon which a toilet seat and bowl lid (both not shown) may be supported. The bowl rim 18 also will generally have an internal hollow water passageway 22 extending therethrough with slots or orifices 24 therein to direct the flushing water over the interior surface 15 of the bowl 12. When the flushing mechanism (not shown) of the tank 14 is actuated, water exits the tank 14 through the tank outlet 25 and flows into the rim internal passageway 22 and then out through the orifices 24. The water and waste matter in the bowl are flushed out of the bowl into a drain mouth 26 at the bottom of the bowl 12 and through a drain passage 30 to exit the toilet. The convoluted and relatively narrow drain passage 30 can become blocked or clogged by foreign objects or waste materials (such as a large quantity of toilet paper) that become lodged in the passage 30 and partially or completely obstruct any further flow of water or waste matter out of the bowl 12.

A toilet plunger 28 (see FIGS. 1 and 2) is often utilized to dislodge an obstruction lodged in the toilet drain passage 30 and is typically comprised of an elongate handle shaft 32 with a deformable rubber force or suction or plunger cup 34 fixed on one end of the handle shaft 32. The concave plunger cup 34 typically has a substantially hemispherical hollow interior chamber 38 therein which is surrounded by an annular circumferential lip 36 that is seated firmly against the interior surface 15 of the bowl 12 around the drain mouth 26 during the plunging operation. If there are gaps between the cup lip 36 and the bowl surface 15, the forceful escape of water through these gaps can cause accidental splashing of water and waste material upwardly through the bowl opening 16 and outside the bowl.

The splash plate 40 of the invention contains or confines to the bowl interior any water or waste matter that is splashed upwardly through the upper bowl opening 16. The plate 40 has an outer perimeter edge and inwardly adjacent to the outer perimeter edge is a perimeter border 41, which is a flat area or portion of the plate that rests upon the flat upper surface 20 of the bowl rim when the plate covers the upper opening 16 of the bowl 12 (see FIGS. 1 and 2). The outer perimeter edge is preferably comprised of a curved edge portion 42 (lying in the plane of the flat perimeter border) and a substantially straight edge portion 44 (also lying in the plane of the flat perimeter border). The preferred plate is sufficiently large to cover the bowl opening, and the width of the flat perimeter border 41 along the outer perimeter edge is sufficiently large so that the perimeter border is capable of resting flatly on the rim surface 20 of a wide range of bowl rim sizes and perimeter shapes.

The curved perimeter edge portion 42 of the illustrated plate 40 is of a generally oval shape (see FIG. 1), with the substantially straight edge portion 44 truncating or cutting off a narrow end portion of the oval. The straight perimeter edge portion 44 provides clearance for toilet seat hinges (not shown) or the toilet tank 14 (each typically being mounted on a rearward extension 21 of the upper surface 20 of the bowl rim) when the plate is placed on the bowl rim 18. The most preferred plate 40 is sufficiently large to protrude outward beyond the outer edge of most bowl rims up to about 3 cm (about 1.2 inches). A protruding plate portion provides a useful handhold for grasping the plate to lift or position the plate on the bowl rim. An illustrative plate capable of covering a large range of rim shapes and sizes is a truncated oval of about 39 cm (about 15 ⅜ inches) wide (up to about 40 cm wide) and about 40 cm (about 16 inches) long (up to about 46 cm long).

The splash plate 40 has opposite faces 44 and which for the purposes of description will be referred to as a bottom face 46 and top face 48 (although in some embodiments of the invention the faces 46, 48 may be virtually identical to each other). During use of the plate 40, the bottom face 46 is oriented downward toward the bowl rim upper surface 20 and the top face 48 is oriented upward toward the plunger operator.

The plate 40 has an aperture 50 therein (see FIG. 1) to permit the handle shaft 32 of a plunger 28 to pass through the plate. The aperture 50 is treated as being centrally located on the plate, although it may be slightly offset from the precise center. For example, it may be slightly offset toward the straight perimeter edge portion 44. A slight offset may permit better vertical alignment of the plunger with the drain mouth 26 of the toilet bowl. (The drain mouth typically is located more toward the rear of a bowl than at the precise center.) The plate 40 is preferably large enough so that the plate can be shifted laterally or longitudinally on the bowl rim to substantially align the aperture 50 and the drain mouth 26 without uncovering a portion of the upper opening 16 of the flush toilet.

The size of the aperture 50 (see FIGS. 1 and 2) is just sufficiently large to permit the free movement of the plunger handle shaft 32 therethrough when the handle is reciprocated during the plunging operation. The aperture 50 is not sufficiently large to permit the plunger action cup 34 to pass therethrough, and should be small enough to minimize the possibility of water from the bowl splashing up between the handle shaft and the plate edges forming the aperture. In the illustrative embodiment, the aperture 50 is circular with a diameter of about 3 cm (about 1.2 inches), although diameters of about 2.5 cm (about 1 inch) to about 4 cm (about 1.6 inches) could be used. These diameters accommodate the popular plunger shafts that now are more or less standardized. The size of the standard suction cup is several centimeters larger.

Figure 5:
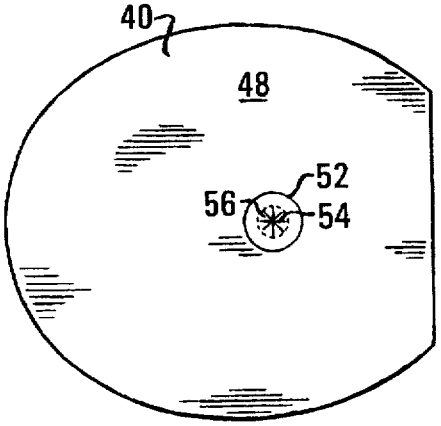
FIG. 5 is a schematic top view of an alternate embodiment for a splash plate, namely one having an optional flexible membrane.

Optionally, the small aperture 50 may be covered by a flexible membrane 52 (see FIG. 5) to provide additional splash blocking between the handle shaft 32 and the plate edge at the aperture. The membrane 52 is preferably a single piece of a flexible sheet material (e.g., a thin plastic) that is affixed or bonded to the top face 48 of the plate 40 at locations lateral to the aperture 50. The membrane 52 has a number of radial slits 54 therein that intersect above or adjacent to the center of the aperture 50 and form multiple flaps 56 flexibly biased to press against a plunger handle shaft 32 inserted through the aperture. The flaps 56 do not significantly impede or restrict the movement of the handle shaft through the aperture 50.

A critically significant feature of the invention is the visual transparency of the plate 40. The visually transparent material of the plate permits the plunger operator to look down through the plate from above and see into the bowl interior while the plate rests on the bowl rim 18 and fully covers upper opening 16. The visual transparency feature provides several advantages during practice of the invention, as noted further below.

The splash plate 40 is unitary and preferably formed from a single piece of sheet material. The preferable sheet material has smooth surfaces with no joints or narrow ridges or cracks or crevices (or other small surface voids) that might catch and retain splashed matter on the bottom 46 (or top 48) faces of the plate during use. The smoothness of the faces 46, 48 permits any matter that is splashed onto the plate to quickly drain off the smooth faces upon tilting the plate over the bowl opening, and any remaining spatters may be easily wiped off of the plate without the need for extensive scrubbing.

The splash plate 40 is also stiff, but may exhibit some flexibility as long as the plate is sufficiently resilient to return to its original shape after the deforming force is removed. The splash plate should be sufficiently stiff to resist excessive flexing that may cause gaps between the flat perimeter border of the bottom face 46 and the upper surface 20 of the bowl rim during the plunging action. Optionally, the plate may have a high degree of stiffness and be substantially or completely rigid (e.g., virtually no flexing of the plate is possible) although such maximum stiffness is not critical for satisfactory plate performance. The stiffness exhibited by the splash plate may be affected by factors such as, for example, the thickness and physical characteristics (e.g., strength) of the sheet material employed and any contouring of the splash plate.

All portions of the splash plate, including the portions at and near the perimeter edges, are ideally of a substantially uniform thickness. The sheet material employed for the plate preferably has a uniform thickness of about 0.5 cm (about ⅜ inch) or less. The sheet material may be as thin as about 0.15 cm (about 0.06 inch) or even as thin as about 0.1 cm (about 0.040 inch) or less, as long as the splash plate produced is substantially stiff. Significantly, relatively thin sheet materials may be obtained in economical roll form for plate manufacture, and may permit the use of simple and economical cutting and shaping (e.g., vacuum forming) methods, if required. Sheet materials having a thickness up to about 0.5 cm (about ⅜ inch) or even up to about 6.5 mm (about ¼ inch) may also be used but tend to produce needlessly heavy and cumbersome splash plates.

The preferred material for forming the plate 40 comprises a transparent plastic. One such transparent plastic is polymethyl methacrylate, such as is sold under the trade name PLEXIGLAS. A transparent plate formed of about 0.35 cm (about ⅛ inch) thick polymethyl methacrylate is sufficiently stiff and strong for the function it is to perform, and in addition is exceedingly light weight and easy to carry. Moreover, other visually transparent plastics may also be suitable for fabricating the splash plate, such as polyvinylchlorides, polyethylenes, acrylonitrile butadiene styrene (ABS), and may permit the use of sheet materials much thinner than 0.35 cm, even as thin as about 0.1 cm.

Figure 2:
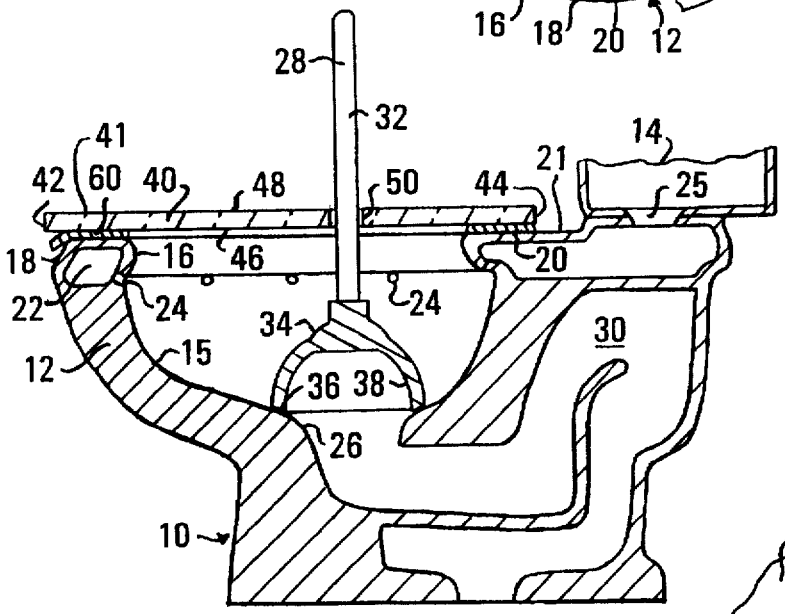
FIG. 2 is a schematic sectional view taken along line 2—2 of FIG. 1.

A substantial portion of the splash plate is preferably flat, and in the first illustrative embodiment of the invention, the plate 40 is entirely flat and all portions of the sheet material lie in substantially the same plane as the flat perimeter border 41 (see FIGS. 1 and 2). The completely flat or planar bottom 46 and top 48 faces of the plate 40 are easy to wipe clean and the plate is exceptionally slim and compact.

The stiffness of the splash plate may optionally be enhanced by forming a contour into a portion of the substantially flat plate, a feature which permits the use of exceptionally thin and lightweight and economical types of plastic sheet materials for the splash plate. A second embodiment of the invention comprises a splash plate 74 (see FIGS.

6 and 7) that features a contour formed or pressed into the uniformly thick sheet material of the plate. The contour creates on each face of the plate 74 a contoured area or portion 76 where the sheet material extends or protrudes out of the plane of the flat perimeter border 41. Illustratively, a raised or protruding contour is created on one (e.g., the top 88) face and a depressed or sunken contour is created on the other (e.g., the bottom 89) face.

The cross section of the contoured portion (e.g., taken in a plane that is perpendicular to the plane of the perimeter border 41 and extends through the central aperture) may vary in shape. The cross sectional shape of the contoured portion 76 has a width dimension measured in a direction parallel to the plane of the perimeter border 41 and a height dimension measured in a direction perpendicular to the plane of the perimeter border 41. The width of the contour is preferably maximum at the base of the contour (i.e., the part of the contour nearest to the plane of the perimeter border 41) and preferably tapers or becomes narrower as the distance from the plane of the perimeter border increases. The height of the contour's protrusion out of the plane of the perimeter border is less than about 3 cm (about 1.2 inches), but preferably greater than about 1 cm.

The width of the contour 76 is relatively broad with respect to its height. Preferably, the width is at least about equal to the height, and ideally is about 2 to 4 or even more times the height dimension. Contours corresponding to this preferred height to width relationship are less likely (than comparatively narrower contours) to catch and hold matter therein and are easier to thoroughly clean after use.

The contour 76 of the illustrative plate 74 has a cross sectional shape ranging from gradual curvature to that resembling an inverted V having walls 82, 83 that extend or protrude outwardly from the plane of the perimeter border (and upwardly from the top face 88) and slope or slant inwardly toward each other and meet at a rounded peak Other cross sectional shapes, such as, for example, semicircular and semi-elliptical or even somewhat rectangular, may also be used. The cross section of the contour 76 is preferably similar at all locations along the contour. Variations in the shape and size (e.g., the height) of the contour's cross section may be employed, although such interruptions in the continuity of the contour may somewhat decrease its stiffness enhancing ability. A suitable illustrative V-shaped contour is about 5 cm (about 2 inches) wide and about 1.3 cm (about 0.5 inches) in height.

Viewing the contoured portion 76 in a direction perpendicular to the plane of the planar portion (e.g., a plan view of the top face 88), the contoured portion is located inwardly from the flat perimeter border 41 and is generally centered on the face 88, 89. The flat perimeter border of the contoured plate 74 is located above the upper surface 20 of the bowl rim when the plate is placed over the bowl opening 16. Locating the flat perimeter border 41 (as opposed to the contoured portion 76) of the plate 74 over the upper surface 20 minimizes the possibility of gaps (and leakage) by maximizing the area of the bottom face 44 that is resting flatly in a parallel relationship upon the upper surface 20 of the bowl rim. Ideally, the flat perimeter border 41 is sufficiently large to rest over substantially the entire upper surface of the bowl rim. Also, the parallel relationship maximizes the area of parallel surfaces available for effective seating of an optional gasket interposed between the plate and bowl rim.

The inner contoured portion 76 encircles or surrounds the central aperture 50. Preferably, the contoured portion 76 is also spaced radially outward from the central aperture 50, and a central planar area or portion 80 is provided adjacent to and surrounding the aperture. The central planar portion 80 preferably lies in the plane of the perimeter border 41. The contoured portion 76 thus forms a substantially continuous ring-like protruding area about the central planar portion 80 (and the aperture). In the illustrative embodiment, the contoured portion resembles an oblong ring or a rectangle with rounded corners, although circular or oval or even rectangular-shaped contoured areas may also be employed. The oblong contoured portion 76 effectively enhances the overall stiffness of the splash plate 74, especially against excessive flexing or bowing of the flat parts of the splash plate out of their normal flat shape.

The area of a face 88, 89 that is occupied by the contoured portion 76 is substantially less than the total surface area of that face; the contoured area 76 is less than the flat portions of the plate (e.g., the perimeter border, the central planar portion, and any flat area between the perimeter border and the contoured portion). In the most preferred embodiment, the area of the flat portions is more than about two up to about four or even six times larger than the contoured area.

A splash plate 74 having a contoured portion 76 is preferably rested upon the bowl rim 18 with the contoured portion protruding upward (i.e., away from the bowl opening). In this orientation, the contoured portion 76 tends to confine within the central planar portion 80 any liquid that might rarely escape upwardly through the aperture 50 during use of the plunger, and may even induce any such liquid to drain back through the aperture and back into the bowl. Optionally, the protrusion of the contoured portion may be oriented downward and into the bowl opening 16, and when so positioned, could help prevent an accidental complete slippage of the plate 74 off of the upper surface 20 of the bowl rim.

Figure 6:
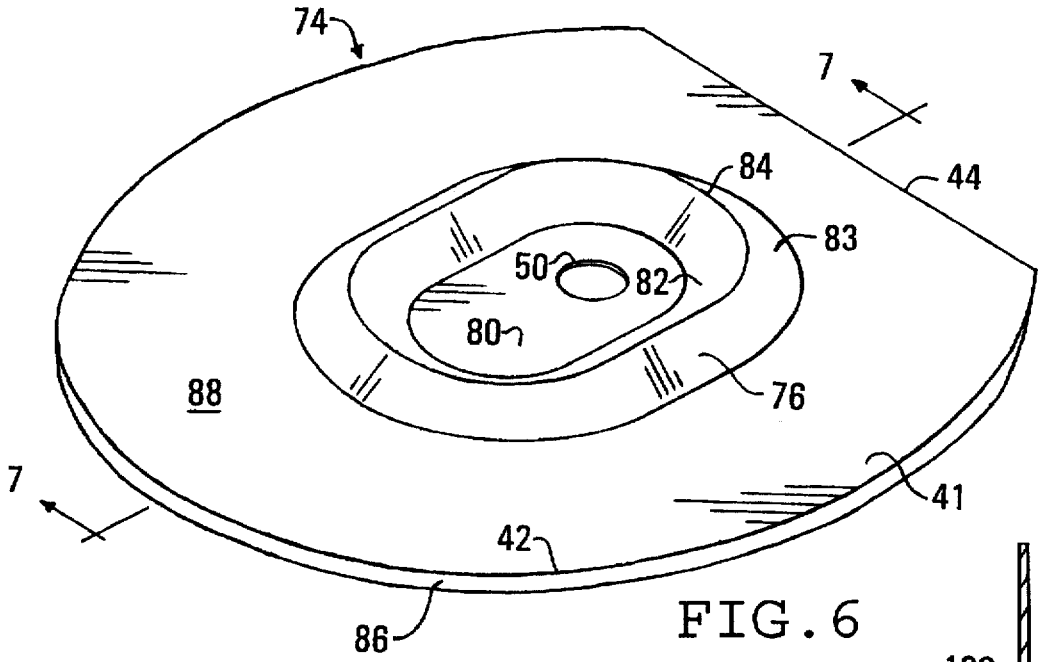
FIG. 6 is a schematic perspective view of a splash plate of the invention having an optional contoured portion and an optional perimeter flange.
Figure 7:
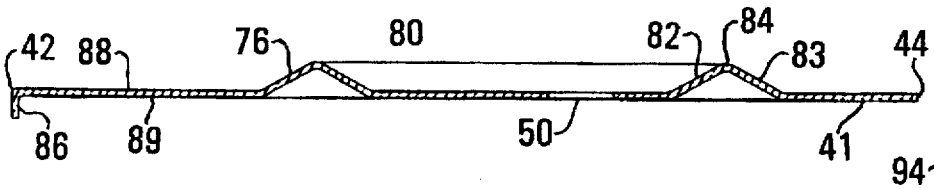
FIG. 7 is a schematic sectional view of the splash plate taken along line 7—7 of FIG. 6.

Another significant optional but preferred feature of the invention is a stiffening flange 86 formed on the splash plate along the outer perimeter edge (see FIGS. 6 and 7) to increase the stiffness exhibited by the splash plate. Especially when combined with the aforedescribed contour 76, the perimeter flange 86 permits the use of exceedingly thin plastic sheet materials to produce a stiff splash plate. The perimeter flange 86 preferably extends in a direction substantially perpendicular to the bottom face 89 such that the flange depends downwardly when the plate is placed on the bowl rim upper surface. The preferred flange 86 extends less than about 3 cm (about 1.2 inches) down from the bottom face 89 and most preferably measures downwardly about 1.5 cm (about 0.6 inches) or less, but more than 0.5 cm. Other flange orientations (such as folding a flange portion of the sheet material back against a face of the plate) may be used, but may provide less effective stiffening.

Significantly, the perimeter flange 86 is formed solely along the curved perimeter edge portion 42. A flange formed along the substantially straight perimeter edge portion 44 would prevent the area proximate to the straight edge portion from resting flatly on the upper surface 20 of bowl rims having a rearward extension 21 of the bowl rim upper surface 20 (see, e.g., FIGS. 1 and 2).

When the plate 40 is rested on a bowl rim 18, the perimeter flange 86 is normally and preferably spaced laterally outward from the bowl rim as a result of the generally large nature of the plate's outer perimeter (in comparison to the size of many bowl rims). Significant contact between the flange 86 and the bowl rim 18 is generally undesirable since such contact could interfere with effective lateral shifting adjustment of the plate position on various sizes and shapes of bowl rims. Although the perimeter flange does not effectively assist in aligning or securing the plate on a bowl rim, the perimeter flange may provide some impediment to a substantial lateral movement of the plate and thus could prevent accidental slippage of the plate completely off of the bowl rim during usage.

A significant and generally preferred feature of the invention is the gasket 60 that is interposed between the bottom face 46 of the flat perimeter border 41 of the plate 40 and the upper surface 20 of the bowl rim 18 (see FIGS. 1 and 2). The gasket 60 forms a cushion and also an absorbent barrier that closes gaps between the plate 40 and the rim upper surface 20. (Such gaps might allow some splashed bowl water to seep out between the plate and rim.) The gasket is a discrete and entirely separate entity that is unattached to the bottom face 46 of the plate. Thus, the gasket can easily be disposed of after use, and replaced with a new disposable gasket at the next use of the splash plate 40. (It should be noted that while the gasket is described herein with respect to the substantially flat splash plate 40, it is also useful with the contoured splash plate 74).

Figure 3:
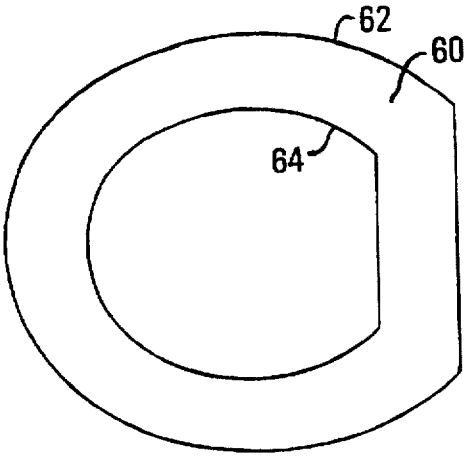
FIG. 3 is a schematic top view of a gasket for practicing the invention.

The preferred gasket 60 (see FIG. 3) has an annular configuration, conforming in general to the upper surface of the bowl rim. The outer edge 62 of the gasket is most preferably the same size and shape as the outer perimeter edge portions 42, 44 of the plate 40. The inner edge 64 of the gasket preferably has a shape that is similar to the outer edge 62 but is smaller in diameter or perimeter size. It nevertheless must not obstruct view into the interior of the bowl 12. The illustrative gasket 60 is a generally circular strip about 3 to 7.5 cm (about 1 to 3 inches) wide at all points along its perimeter. Gaskets of other shapes and sizes may also be used effectively.

To provide easy disposability, the gasket 60 is formed of a paper material capable of sufficient disintegration when immersed in water so that the gasket can be safely flushed down the toilet without itself becoming a clogging obstruction in the drain. The gasket material should not disintegrate merely upon becoming wet (such as may occur when the gasket is being used between the plate and the bowl rim) but should be capable of being broken down into small pieces or fibers by the agitation or mechanical action commonly encountered by waste matter in the sewer system.

The paper material of the gasket 60 is preferably an absorbent fibrous sheet material. An illustrative and preferred gasket material is the material used for the "paper towel" products often utilized in home kitchens for absorbing spills and general cleanup.

Figure 4:
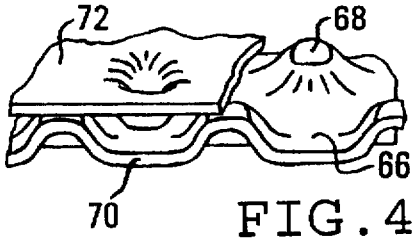
FIG. 4 is a schematic edge view of a magnified broken-away portion of a preferred gasket showing the embossed surface portions and preferred two ply construction thereof.

The most preferred paper material for the gasket 60 features an embossed surface (see FIG. 4). The gasket major surface 66 has a pattern of small embossed or raised surface areas 68 located at regular intervals along the surface 66. The embossed surface increases the overall thickness of the gasket 60 and thereby enhances the gasket's gap-filling capability (as compared to a gasket having a totally flat surface). The gasket 60 may be comprised of two or more plies or layers of the embossed paper material lightly or weakly bonded together, to provide additional absorbency capacity and also additional thickness to the gasket 60. Illustratively, a first ply 70 (see FIG. 4) is weakly bonded or matched to a second ply 72 with the raised surface areas of the respective plies facing each other in a random relationship (or a mated relationship, if desired).

The use of the splash plate 40 of the invention during a toilet plunging operation will now be described (see FIGS. 1 and 2). (References made to usage of the substantially flat splash plate 40 are also applicable to the use of the contoured splash plate 74.) The plunger 28 is suitably positioned in the toilet bowl 12 with the plunger cup 34 placed over the drain mouth 26. Before or after the plunger is thus positioned, a gasket 60 is preferably placed on the upper surface 20 of the bowl rim 18 so that the entire circumference of the rim is substantially covered by the gasket. The gasket is merely laid on the rim. It is not attached mechanically or by any adhesive. The upstanding handle shaft 32 of the plunger is inserted through the aperture 50 as the plate is lowered onto the gasket 60 and the rim 18. (If desired, the plunger handle may first be fitted in the aperture of the plate and then the plunger lowered into the bowl as the plate is lowered onto the gasket.) The plate 40 may be laterally shifted on the bowl to establish the proper alignment of the plate with respect to the gasket 60, the bowl rim 18 and upper opening 16, and the drain mouth 26. The establishment of the proper alignment of these elements is made significantly easier by the transparency of the plate, which permits visual checking of the alignments without having to remove the plate from its proper position over the bowl opening. Additionally, the plunger operator can visually check the orientation of the plunger cup 34 with respect to the drain mouth 26 before beginning the reciprocation of the plunger 28 and without removing the plate from the bowl opening 16. The plunger cup may be adjusted accordingly as needed. Such adjustment may comprise, for example, moving or tilting the plunger handle or laterally or longitudinally shifting the plate (and the position of the aperture 50). The ability to view the interior of the bowl with the plate in position eliminates the need to regularly move or remove the plate from its position on the rim in order to check and adjust the orientation of the plunger cup on the drain mouth.

Once the plunger operator visually determines that the plate, gasket, and bowl rim are properly aligned and that the plunger cup 34 is in the desired orientation over the drain mouth, the plunging operation may be commenced by reciprocating the plunger handle 32 in an upward and downward movement. As the handle 32 is reciprocated, a hand or knee of the operator should be used to manually press downwardly on the plate to hold the plate against the upper surface of the bowl rim (and provide additional compression of the gasket when a gasket is used). No adhesive or mechanical structure (e.g., a mechanical fastener such as a suction cup) is needed to hold the plate on the rim.

Another significant benefit of the transparency feature is the ability to visually monitor or check the plunger cup orientation over the drain mouth 26 as the plunger is being reciprocated. Maintaining the plunger cup in its proper position can decrease the amount of splashing produced by the plunger. Also, the transparency feature allows the operator to visually adjust plunger operation for effective removal of an obstruction and to determine when the obstruction has been dislodged and when the plunging action can be discontinued (e.g., by observing the draining of any previously trapped water from the bowl).

After the plunging action has been terminated, the plate 40 is lifted off of the rim surface 20 and off of the plunger handle 32, as by grasping the outer perimeter edge portion 42, 44 of the plate and lifting. Optionally, the plate may be removed from the bowl rim by lifting the plunger 28 out of the bowl, with the plunger handle shaft 32 sliding through the plate aperture (or, in effect, with the plate sliding down on the handle shaft 32) until the top of the plunger cup 34 contacts the bottom face 46 of the plate adjacent to the aperture 50 and the plate is then raised off of the rim with the plunger. The plunger handle 32 may then be tilted into a horizontal position so that the plate is substantially vertical and any liquid remaining on the smooth bottom face 46 may drain or drip off of the plate into the bowl. This can be accomplished without the plunger operator having to grasp the plate. Any remaining water or waste matter may then be wiped or rinsed off of the plate and into the bowl opening 16. The transparency of the plate makes it easy to visually check the cleanliness of the plate by looking through it and noticing anything remaining on either side of it.

Once the plate has been removed from the bowl rim 18, the gasket 60, if used, may be disposed of by moving or pushing the gasket off the rim into the bowl opening 16 so that the gasket falls into the bowl, absorbs water from the bowl, and collapses into a soft mass. The gasket may then be flushed down the drain mouth 26 of the toilet. Disposal of the gasket by flushing is especially advantageous because the gasket may become wet or otherwise soiled during use, and flushing the gasket down the toilet after use is exceedingly convenient and sanitary and eliminates the need to clean the gasket. The gasket may also be disposed of by simply placing the gasket into a trash container. A new disposable gasket should be used each time the plate is used.

A kit for practicing the invention conveniently may consist of the transparent plate member and a reusable envelope 90 employed as a container for holding the splash plate. Anywhere from one to a dozen or more gaskets may be included. The envelope may be used for store sales display of the splash plate prior to purchase, and significantly may also be used as a convenient reusable storage container for the plate and any gaskets after purchase and after each usage.

Figure 8:
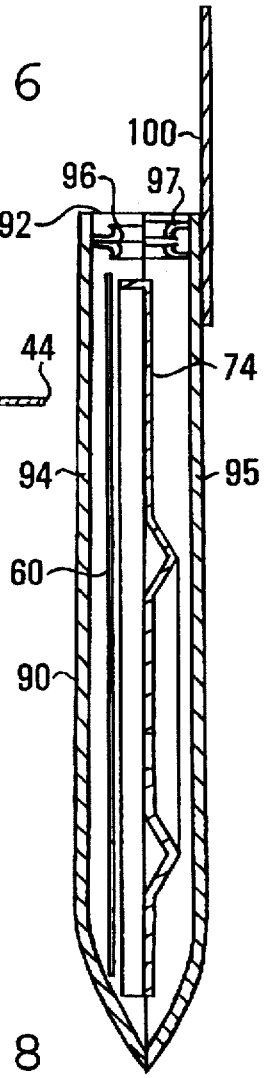
FIG. 8 is a schematic sectional view of a kit of equipment for practicing the invention.

Significantly, the envelope 90 (see FIG. 8) features an opening 92 with a closure permitting repeated opening and reclosure of the opening 92. The envelope 90 is preferably constructed of opposing flexible panels 94, 95 united or fixed together at their peripheral edges. The opening 92 along one edge of the envelope's panels provides access into the envelope's interior, which is sufficiently large to receive the splash plate and one or more gaskets. The preferable closure is comprised of mating parallel ridges 96, 97 formed on each panel 94, 95 of the envelope adjacent to the opening 92. The mating ridges 96, 97 are adapted to releasibly interlock when the ridges are pressed together. One suitable type of reclosable closure is available on storage bags sold under the ZIPLOC trade name by DowBrands of Indianapolis, Ind.

The thin character of the splash plate of the invention permits the use of the reusable envelope 90 for convenient storage before and after use of the plate.

The envelope 90 is preferably transparent. Optionally, a header card 100 is removably mounted above the opening 92 of the envelope 90 and may have suitable advertising and labeling thereon and also may have a hole therein (not shown) to permit hanging display of the kit in a store and hanging storage of the kit between uses.

The thin kit package is inviting for merchants because of the relatively small space required for display purposes as well as for maintaining a supply of the kits available for sale. Since the plunger element for practicing the invention is a rather standard item of commerce and well known and even owned by many persons, it is unnecessary to include the plunger element as a part of a composite kit, although it may be included, if desired.

Those skilled in the art will readily recognize that this invention may be embodied in still other specific forms than illustrated without departing from the spirit or essential characteristics of it. The illustrated embodiment is therefore to be considered illustrative and not restrictive, the scope of the invention being indicated by the appended claims rather than the foregoing description; and all variations that come within the meaning and range of equivalency of the claims are intended to be embraced thereby.

That which is claimed is:

1. A system for containing the splashing produced when using a toilet plunger to unclog a flush toilet, wherein said toilet comprises a bowl with an upper opening and a lower drain mouth below said upper opening, and a bowl rim with a flat horizontal upper surface surrounding the upper opening of said bowl, and wherein said plunger comprises an elongate handle shaft and a deformable plunger cup mounted thereon for positioning over the drain mouth of said bowl, said system comprising a stiff unitary uniformly thick splash plate having an outer perimeter edge and a flat perimeter border inwardly adjacent to said perimeter edge, said plate being of a size adapted to cover the upper opening of said bowl when the flat perimeter border of said plate is rested upon the upper surface of said bowl rim, said plate being visually transparent and having a central aperture formed therein of a size dust sufficiently large to permit free movement therethrough of the handle shaft of said plunger, said splash plate having an inner contoured portion substantially encircling said aperture and located inward of said flat perimeter border, the contour of said inner contoured portion being a protrusion out of the plane of said flat perimeter border, said protrusion being less than about 3 cm in height and being effective to enhance the overall stiffness of said splash plate, the area of said protrusion being less than the area of flat portions of said splash plate, and said splash plate having a uniform thickness of less than about 0.5 cm, wherein the outer perimeter edge of said splash plate has a curved edge portion lying in the plane of said perimeter border and a substantially straight edge portion lying in the plane of said perimeter border, and wherein said splash plate additionally comprises a perimeter flange depending downwardly solely from said curved edge portion of said perimeter edge.

2. A system for containing the splashing produced when using a toilet plunger to unclog a flush toilet, wherein said toilet comprises a bowl with an upper opening and a lower drain mouth below said upper opening, and a bowl rim with a flat horizontal upper surface surrounding the upper opening of said bowl, and wherein said plunger comprises an elongate handle shaft and a deformable plunger cup mounted thereon for positioning over the drain mouth of said bowl, said system comprising a stiff unitary uniformly thick splash plate having an outer perimeter edge and a flat perimeter border inwardly adjacent to said perimeter edge, said plate being of a size adapted to cover the upper opening of said bowl when the flat perimeter border of said plate is rested upon the upper surface of said bowl rim, said plate being visually transparent and having a central aperture formed therein of a size just sufficiently large to permit free movement therethrough of the handle shaft of said plunger, said splash plate having an inner contoured portion substantially encircling said aperture and located inward of said flat perimeter border, the contour of said inner contoured portion being a protrusion out of the plane of said flat perimeter border, said protrusion being less than about 3 cm in height and being effective to enhance the overall stiffness of said splash plate, the area of said protrusion being less than the area of flat portions of said splash plate, and said splash plate having a uniform thickness of less than about 0.5 cm, wherein said splash plate has a central planar portion located adjacent to said central aperture and substantially surrounded by said inner contoured portion.

3. The system of claim 2 wherein said central planar portion lies in the same plane as said perimeter border.

* * * * *